United States Patent [19]

Iida et al.

[11] Patent Number: 4,897,576

[45] Date of Patent: Jan. 30, 1990

[54] METAL VAPOR DISCHARGE LAMP HAVING STARTER THEREIN

[75] Inventors: Takenobu Iida, Urawa; Jojiro Shiina, Gyoda; Minoru Yasukawa, Kohnosu, all of Japan

[73] Assignee: Iwasaki Electric Co., Ltd., Tokyo, Japan

[21] Appl. No.: 233,622

[22] Filed: Aug. 18, 1988

[30] Foreign Application Priority Data

Aug. 31, 1987 [JP] Japan ..... 62-215352

[51] Int. Cl.[4] ..... H05B 41/14; H01J 7/44; H01J 17/34

[52] U.S. Cl. ..... 315/73; 315/47; 315/240

[58] Field of Search ..... 315/232, 46, 47, 58, 315/59, 61, 73, 232, 240, 241 R

[56] References Cited

U.S. PATENT DOCUMENTS 4,520,294 5/1985 Iida et al. ..... 315/50
4,780,649 10/1988 Scholz et al. ..... 315/326

*Primary Examiner*—David Mis
*Attorney, Agent, or Firm*—Armstrong, Nikaido, Marmelstein, Kubovcik & Murray

[57] ABSTRACT

In parallel connecting a starter to a luminous tube, the starter being formed by a coiled nonfusible metal wire which is wound to or laid along the outer wall of the luminous tube and a nonlinear capacitor which is in series connected to the nonfusible metal wire. As a result of this, the discharge lamp can be assuredly and stably lit with a small size ballast. Furthermore, pass of large current through the starter can be prevented even if the luminous tube is leaked. Furthermore, if the vacuum outer bulb is leaked or broken, the circuit of the starter can be opened by melting the nonfusible metal wire.

14 Claims, 4 Drawing Sheets

METAL VAPOR DISCHARGE LAMP HAVING STARTER THEREIN

BACKGROUND OF THE INVENTION

This invention relates to improvement in a metal vapor discharge lamp which is constituted in such a manner that a starter connected in parallel to a luminous tube is accommodated in a light transmissible outer bulb, and more particularly to improvement in a high pressure sodium lamp having a starter therein.

FIG. 1 shows an example of the structure of a circuit for use in a conventional metal vapor discharge lamp having a starter therein. A metal vapor discharge lamp of the type described above is constituted in such a manner that a starter 5 formed by a series circuit comprising a bimetal switch 2, a heater 3 and a limiting current resistor 4 is, in parallel, connected to a luminous tube 1, and the thus connected components are accommodated in a light transmissible outer bulb 6. When an A.C. voltage is applied to the thus-constituted discharge lamp which has been connected to an A.C. power source 8 via an inductor 7, an electric current passes through the starter 5 formed by a series circuit comprising a bimetal switch 2, a heater 3 and a limiting current resistor 4. As a result of this, the bimetal switch 2 repeats switching on/off operation. This leads to a fact that high voltage pulses are generated in the inductor 7, and are added, with the power source voltage, to the luminous tube 1, causing the discharge lamp to be lit.

By using the above-described starter which utilizes switching on/off operation performed by the bimetal switch 2, a substantially several thousand volts of high voltage pulses can be generated. Therefore, such discharge lamp can be started lighting by using a relatively small size ballast. However, since the mechanical switching on/off operation of the bimetal switch 2 is utilized, the heights and the intervals of the generated pulses cannot be uniformed, the starting characteristics of the discharge lamp is not stable, or an exceeding high voltage pulses are involved to be generated, causing the wiring instruments or the like to be damaged.

In order to overcome the above-described problems, a metal vapor discharge lamp was disclosed in which a nonlinear capacitor 9 thereof is, as shown in FIG. 2, connected, in parallel, to the luminous tube 1 with a thermal response type switch 10, and the thus-connected components are accommodated in a light-transmissible vacuum outer bulb 6. The starter of this discharge lamp utilizes the nonlinear capacitor 9 as a switching element depending upon the hysteresis characteristics of the charge of the nonlinear capacitor 9 with respect to the voltage thereof. The thermal response type switch 10 is provided for the purpose of separating the nonlinear capacitor 9 which serves as a starter from the luminous tube 1 after the discharge lamp has started lighting.

In this starter, since high voltage pulses are generated in the inductor 7 utilizing the electrical switching on/-off operation of the nonlinear capacitor 9, the heights and intervals of the generated high voltage pulses are made very regular and stable. However, the thus-generated high voltage pulses are within the range of substantially 1000 to 3000V, this level being slightly lower than that in a case of a starter comprising a bimetal switch. Therefore, in order to assuredly start the discharge lamp, the nonlinear capacitor and its circuit elements need to be designed in such a manner that the high voltage pulses which are very close to the upper limit of the above-described pulses can be generated.

However, a fact was found that the starter and the like designed as described above will easily cause the following failures: when the light-emitting life of the discharge lamp reaches its final stage, causing the rare gases in the luminous tube 1 to be leaked in the vacuum outer bulb 6 or causing the vacuum outer bulb 6 to generate slow leak, the withstand voltage of the nonlinear capacitor 9 is reduced, as a result of which discharge occurs between its two electrodes. It leads to a fact that a large electric current is caused to be passed through the starter circuit. Consequently failures that the circuit elements such as the inductor 7 are damaged easily occur. Although the nonlinear capacitor 9 is finally broken due to discharge between the two electrodes of the nonlinear capacitor 9, causing the circuit of the starter to be shut off, a large current which passes through in a short time until the breakage occurs will cause the above-described failure.

SUMMARY OF THE INVENTION

This invention is achieved for the purpose of overcoming the above-described problems experienced in the conventional metal vapor discharge lamp having a starter therein.

An object of the present invention is to provided a metal vapor discharge lamp having a starter therein which can assuredly and stably start light emission even with a small size ballast.

Another object of the present invention is to provided a metal-vapor discharge lamp having a starter therein in which pass of large electric current through the starter is prevented even if leakage failure occurs in the luminous tube, causing the nonlinear capacitor to be made short circuited.

A further object of the present invention is to provide a metal vapor discharge lamp having a starter therein in which the circuit of a starter thereof is arranged to be opened when leak or breakage failure occurs in the vacuum outer bulb.

In order to achieve the above-described objects, a metal vapor discharge lamp which is constituted in such a manner that a starter which is in parallel connected to a luminous tube is accommodated in a light transmissible vacuum outer bulb thereof, the metal vapor discharge lamp is characterized in that: the starter comprises a coiled nonfusible (hard to be fused) metal wire which is wound to or laid along the outer wall of the luminous tube in a contact manner and a nonlinear capacitor which is connected to an end of the nonfusible metal wire.

As a result of the above-described structure, since the coiled nonfusible metal wire acts as a so-called adjacent conductor for assisting starting, causing the discharge lamp to be started easily. Therefore, the discharge lamp can be assuredly and stably lit only with a relatively small size ballast. Furthermore, since the generated high voltage pulses are applied to the nonlinear capacitor through the nonfusible metal wire, discharge is difficult to occur between the two electrodes of the nonlinear capacitor even if the rare gases leak from the luminous tube. Even if such discharge occurs, causing a large current to be made pass through the nonlinear capacitor, such actual large current does not actually pass since the nonfusible metal wire serves as a current limiting resistor.

Furthermore, if a large quantity of air is introduced into the vacuum outer bulb due to breakage of vacuum outer bulb, the nonfusible metal wire becomes incandescent and broken by heat from the luminous tube. This leads a fact that the circuit of the starter is opened and the luminous tube is as well leaked, causing the discharge lamp to be made in a non-light emitting state, and generation of high voltage pulses to be prevented. Consequently, assuredly and stably starting and safety at the time of failures can be simultaneously obtained.

DESCRIPTION OF THE PREFERRED EMBODIMENTS

Figure 1:
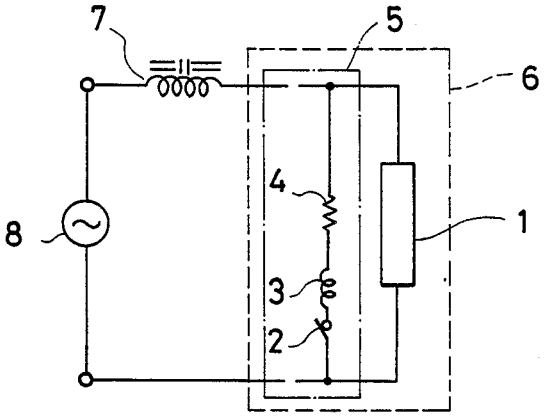
FIG. 1 PRIOR ART
FIGS. 1 and 2 are views illustrating the schematic structure and a lighting circuit for use in a conventional metal vapor discharge lamp having a starter therein.
Figure 2:
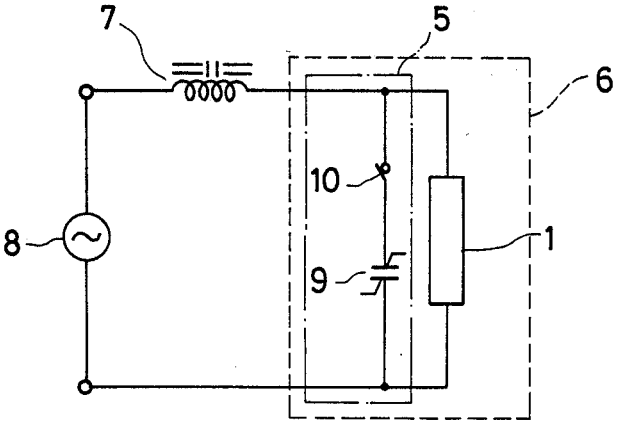
FIG. 2 PRIOR ART
Figure 3:
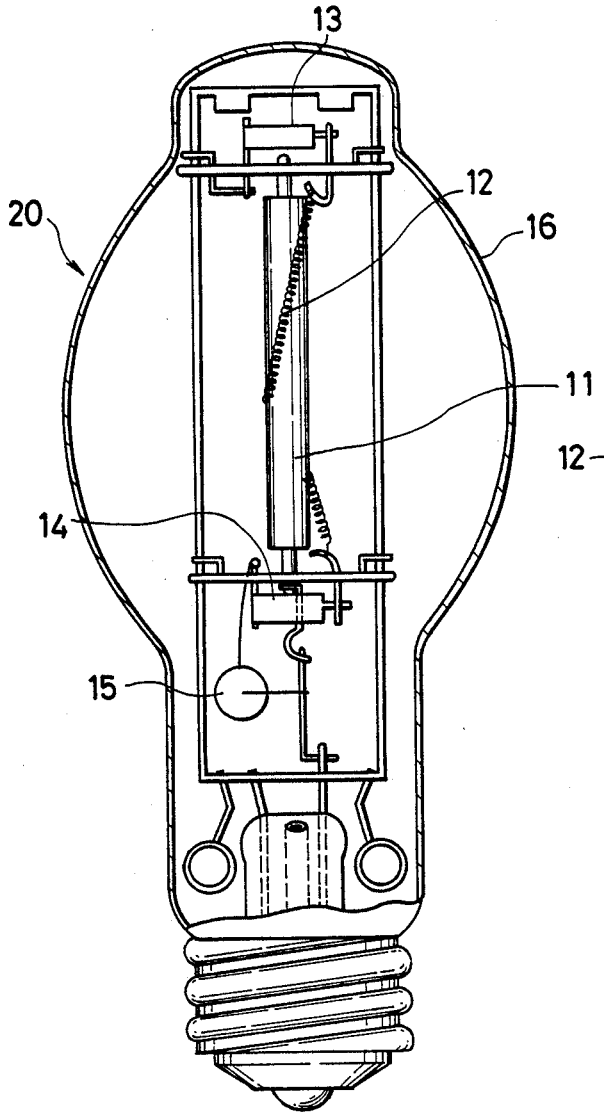
FIG. 3 is a cross-sectional view, from which a part is omitted, of a metal vapor discharge lamp according to a first embodiment of the present invention.
Figure 4:
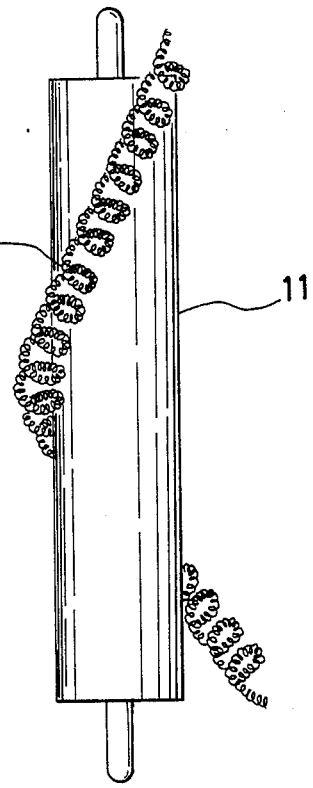
FIG. 4 illustrates a part of a modified example of the first embodiment in which a double coiled nonfusible metal wire is used.

FIG. 3 illustrates a metal vapor discharge lamp according to a first embodiment of the present invention. Reference numeral 11 represents a luminous tube which has at least a pair of electrodes and in which a substance such as rare gas and the other substances are enclosed. In a case of a high pressure sodium lamp, this luminous tube 11 is made of a material such as light-transmissible alumina ceramics, and in which a rare gas such as xenon gas is enclosed together with sodium and mercury. Reference numeral 12 represents a nonfusible metal wire in the form of a coil which is wound to or laid along the outer wall of the luminous tube 11. As the non-fusible metal wire 12, a tungsten wire is most preferable for use, and is formed in a single coil or, as shown in FIG. 4, a double coil.

An end of this non-fusible metal wire 12 is connected to a power supply portion disposed at a side of the luminous tube 11 via a thermal response switch 13 such as a bimetal switch. Another end of the same is connected to an electrode disposed at a side of a nonlinear capacitor 15 via another thermal response switch 14. An electrode disposed at another side of the nonlinear capacitor 15 is connected to a power supply portion disposed at another end of the luminous tube 11. Thus, a series circuit formed by the thermal response switch 13, the non-fusible metal wire 12, the thermal response switch 14 and the nonlinear capacitor 15 constitutes a starter, this starter being in parallel connected to the luminous tube 11. A discharge lamp 20 is constituted by accommodating the luminous tube 11 and the starter in a light transmissible outer bulb 16 thereof.

In the starter described above, the thermal response switches 13 and 14 act to separate the starter from the luminous tube 11 by switching off by virtue of receiving heat from the luminous tube 11 after the discharge lamp has started lighting. The nonlinear capacitor 15 is constituted in such a manner that metalized electrodes are formed on both sides of a disk type body made of a material of barium titanate type, this electrodes being connected with lead wires by a conductive adhesive. Furthermore, the surface of the electrode is over-coated with an insulating material such as glass. Since such a type of nonlinear capacitor has a hysteresis type voltage-charge characteristics, it is made operate similar to a switching element by using the above-described characteristics.

Figure 5:
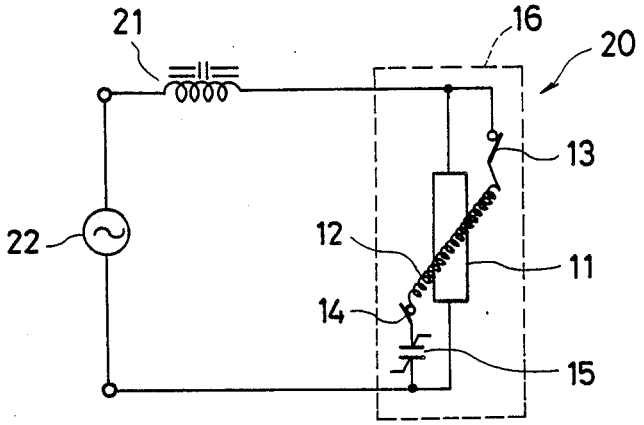
FIG. 5 is a view illustrating the structure of a circuit for use in the first embodiment of the present invention.

When the thus-constituted discharge lamp 20 is connected to an AC power source 22 via an inductor 21 as shown in FIG. 5 in which the structure of the circuit is illustrated, and the same is applied with AC voltage, an electric current passes through the starter, and high voltage pulses are generated by the operation of the nonlinear capacitor 15. Simultaneously, the nonfusible metal wire 12 serves as an adjacent conductor, as a result of which, the discharge lamp 20 can easily start lighting with a relative low pulse voltage.

Figure 6:
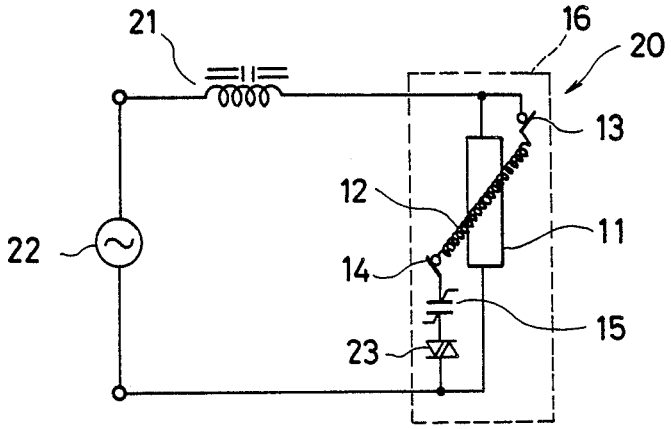
FIG. 6 is a view illustrating the structure of a circuit for use in a second embodiment of the present invention.

FIG. 6 illustrates the structure of a circuit for use in a second embodiment. This embodiment is constituted in such a manner that a semiconductor switch 23 such as TRIAC is connected in series to the nonlinear capacitor 15 of the starter. Since the pulse voltage generated due to switching operation of the nonlinear capacitor 15 can be further raised, it is preferable for use in a discharge lamp of a relatively large capacity.

Figure 7:
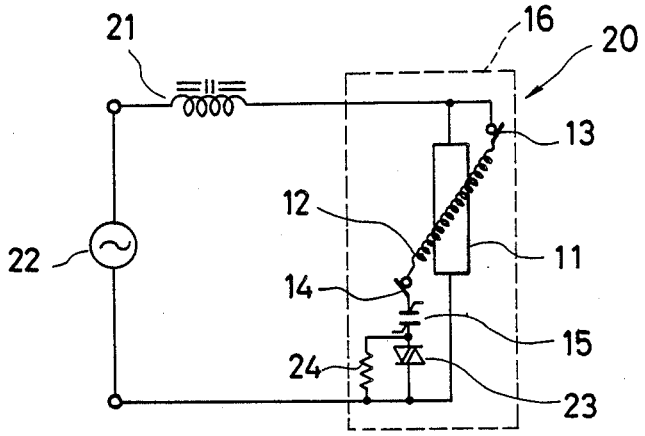
FIG. 7 is a view illustrating the structure of a circuit for use in a third embodiment of the present invention.

FIG. 7 illustrates the structure of a circuit for use in a third embodiment. This embodiment is constituted in such a manner that a shunt resistor 24 is connected in parallel to the semiconductor switch 23 described in the embodiment shown in FIG. 6, this shunt resistor 24 acting to make the breakover voltage of this semiconductor switch 23 stable. As this resistor 24, a type of 15 to 200kΩ is generally used.

Figure 8:
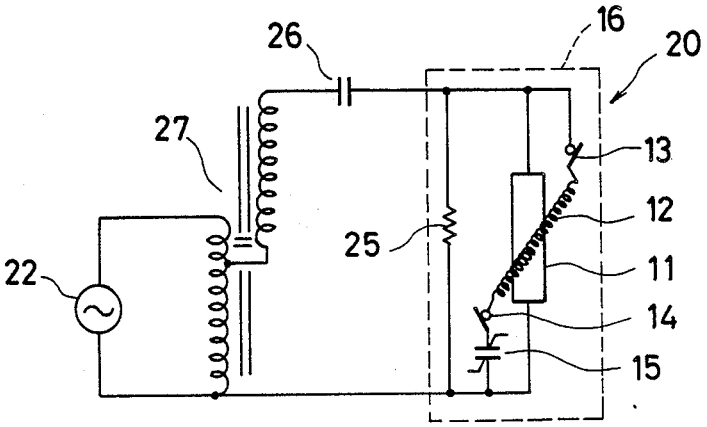
FIG. 8 is a view illustrating the structure of a circuit for use in a fourth embodiment of the present invention.

FIG. 8 illustrates the structure of a circuit for use in a fourth embodiment, this embodiment being able to be applied to a case where a capacitive ballast having a capacitor is used to emit light. That is, a resistor 25, for discharging the electric charge which has been charged in the capacitor of the ballast and immediately returning the starter circuit, is connected in parallel to the starter. The thus-connected resistor 25 is, with the starter, accommodated in the outer bulb 16. As this resistor 25, a type of 10 to 100kΩ is generally used. In this figure, reference numeral 26 represents a series main capacitor, and reference numeral 27 represents a leakage transformer. This embodiment can be also employed in a case where the metal vapor discharge lamp according to the embodiments shown in FIGS. 6 and 7 is lit by using a capacitive ballast.

All of the above-described embodiments exhibits the following advantages in addition to an advantage that the discharge lamp can be assuredly and stably lit by means of the nonlinear capacitor 15 and the nonfusible metal wire 12:

Since the high voltage pulses generated for the purpose of starting the discharge lamp are applied to the nonlinear capacitor 15 via the nonfusible metal wire 12, discharge is prevented from generation between two electrodes of the nonlinear capacitor 15 even if the rare gas leaks in the vacuum outer bulb 16 from the luminous tube 11 at the final stage of the light emission life of the discharge lamp. Even if the discharge occurs, since the nonfusible metal wire 12 serves as a current limiting resistor, pass of large electric current through the nonlinear capacitor 15 is prevented. Furthermore, when a large volume of air is introduced into the vacuum outer bulb 16 due to the breakage of it, the nonfusible metal wire 12 is made incandescent and fused due to heat from the luminous tube. As a result of this, the circuit of the starter is opened. Furthermore, since the luminous tube is also leaked due to creation of cracks in the sealed portion caused from hardening by virtue of oxidation of a niobium tube for supporting an electrode, the discharge lamp does not emit light, and generation of high voltage pulses are also stopped.

However, in order to obtain the above-described effects, the size, the shape, the value of resistance and the like of the nonfusible metal wire 12 need to be properly determined.

In a case where the present invention is applied to a high pressure sodium lamp, and in particularly in a case where a lamp with a small capacity of 150 W or less is used, the preferable structure of the above-described coiled nonfusible metal wire 12 is as follows: a single wire with a diameter of 0.04 to 0.1 mm and the length of 260 to 1200 mm is formed to a single coil with the inner diameter of 0.1 to 0.6 mm and the length of 15 to 100 mm.

The reason for employing the single coiled form in the small capacity lamp lies in that: since such small capacity lamp comprises a small size luminous tube, the light shielding effect due to the presence of the nonfusible metal wire needs to be reduced as possible. If the diameter of the wire is arranged to be less than 0.04 mm or the inner diameter of the coil is arranged to be less than 0.1 mm, the spring effect is reduced, causing the contact of the coil with the outer wall of the luminous tube is deteriorated, and the starting effect to be reduced. If the diameter of the wire exceeds 0.1 mm is arranged to be used, the fusible metal wire cannot be melted even if air is introduced due to the breakage of the vacuum outer bulb. As a result of this, high voltage pulses are continued to be generated.

In an intermediate or large capacity lamp exceeding 180 W, the coiled nonfusible metal wire 12 is preferably to be formed in such a manner that: a single wire with the diameter of 0.03 to 0.1 mm and the length of 260 to 3500 mm is formed to a double coil constituted by a primary coil with the inner diameter of 0.06 to 0.2 mm and the length of 50 to 800 mm and a second coil with the inner diameter of 0.15 to 0.5 mm and the length of 7 to 132 mm.

The reason for employing a double coil in the intermediate or the large capacity lamp lies in that: since the intermediate or the large capacity lamp comprises a relatively long luminous tube and the starting voltage thereof is relatively high, the use of the double coil which has excellent contact performance will help starting. If the diameter of the wire of less than 0.03 mm is used as the fusible metal wire, the nonfusible metal wire is self-heated at the time of pass of electric current through the starter, causing the resistance of the metal to be raised. It leads to a fact that the pulse voltage is lowered and the starting characteristics is deteriorated. On the other hand, if a coil formed by a wire with diameter exceeding 0.1 mm is employed, the nonfusible metal wire cannot be melted, although it is not melted similarly to the case of the single coil, even if air is introduced due to the breakage or the like of the vacuum outer bulb. As a result of this, generation of the high voltage pulses is continued. If the inner diameter of the double coil is 0.15 mm or less, the spring performance of the double coil is deteriorated so that excellent contactness with the luminous tube cannot be obtained. On the other hand, if the inner diameter is made 0.5 mm or more, the luminous flux of the lamp can be excessively reduced due to increase in effect of shielding the luminous tube.

The coiled nonfusible metal wire is arranged in such a manner that the cold resistance becomes 3 to 40 Ω. Since the effective current which passes through the nonfusible metal wire is small enough to be neglected, voltage drop due to the nonfusible metal wire is relatively small if the above-described resistance is within the above-described range. Therefore, the level of the voltage of the generated pulses are not affected.

A specific design example in accordance with the present invention will be described. A design example is described in which the starter according to the second embodiment shown in FIG. 6 was applied to a 360 W-high pressure sodium lamp. The size of the luminous tube 11 was such that the outer diameter was 9 mm and the distance between electrodes was 107 mm. As the coiled nonfusible metal wire 12, a double coil formed by a single wire of diameter 0.069 mm and the length of 1210 mm was employed, the double coil being constituted by a primary coil with the inner diameter of 0.125 mm and the pitch of 200%, and the length of 275 mm and a second coil with the inner diameter of 0.5 mm, the pitch of 160%, and the length of 48 mm. The resistance of this nonfusible metal wire 12 was 20 Ω in a cooled down state (non-heating state), but it was 240 Ω in a hot state (heating state). As the thermal response switches 13 and 14, bimetal switches were employed which were turned on at the time of non-heating state and which were turned off due to heat from the luminous tube 11 and the above-described nonfusible metal wire 12. As the nonlinear capacitor 15, a type was employed which has the saturation characteristics such that the voltage-charge hysteresis characteristics thereof becomes saturated charge Q=33 [μc] when the saturated voltage E=300 [V]. As the semiconductor switch 23, TRIAC with the breakover voltage $V_{BO}$ 220 [V], the peak off current $I_{DRM}$: 10 [μA] (max), the breakover current $I_{BO}$ 0.5 [mA](max), the holding current $I_H$: 50 [mA], the on-state voltage $V_T$: 3.0 [V] (max) was used.

When the thus-constituted high pressure sodium lamp having the starter was lit after connecting to a commercial AC power source of 100 [V], 50 [Hz] via a choke coil ballast for lighting 400 [W] high pressure mercury lamp, high voltage pulses with the peak voltage of substantially 2600 [V] was generated and the high pressure sodium lamp was immediately lit. When the starter was operated, the above-described nonfusible metal wire 12 was in a nonheated state, and the resistance was relatively low value of 20 Ω. As a result of this, the level of the generated high voltage pulses are not effected.

Next, the lamp was lit by introducing slight amount of xenon gas into the vacuum outer bulb of the above-described lamp similarly to a state where rare gas in the luminous tube is leaked. In this case, although discharge was generated between the electrodes of the nonlinear capacitor, the size of current passing through the starter is serial amperes at the largest, therefore, any failure of breakage of the ballast or the like did not occur.

Then, the lamp was lit by introducing air into the vacuum outer bulb of the above-described lamp similarly to a state where the vacuum outer bulb is leaked or broken. In this case, the temperature of the nonfusible metal wire reached 1100° C. or higher by receiving heat from the luminous tube after the lamp had been lit, causing the same to be melted in ten and several minutes, and the luminous tube to be leaked. As a result of this, the discharge lamp was brought to a state where it did not emit light and the generation of high voltage pulses was stopped.

As can clearly understood from the above-description, the metal vapor discharge lamp according to the present invention can be started lighting assuredly and stably even if a relatively small size ballast is employed. Furthermore, if the nonlinear capacitor is brought into a short circuit state due to leak failure of the luminous tube, pass of large current through the starter can be prevented. Furthermore, there is an advantage that if leak or breakage failure occurs in the vacuum outer bulb, the circuit of the starter can be opened.

What is claimed is:

1. A metal vapor discharge lamp which is constituted in such a manner that a starter which is in parallel connected to a luminous tube is accommodated in a light transmissible vacuum outer bulb thereof, said metal vapor discharge lamp being characterized in that: said starter comprising a coiled nonfusible metal wire which is wound to or laid along the outer wall of said luminous tube in a contact manner and a nonlinear capacitor which is in series connected to said nonfusible metal wire.

2. A metal vapor discharge lamp according to claim 1, wherein a resistor which is in parallel connected to said starter is accommodated in said outer bulb.

3. A metal vapor discharge lamp according to claim 1, wherein thermal response switches which are turned on at the time of non-heating are connected to two ends of said nonfusible metal wire which forms said starter.

4. A metal vapor discharge lamp according to claim 2, wherein thermal response switches which are turned on at the time of non-heating are connected to two ends of said nonfusible metal wire which forms said starter.

5. A metal vapor discharge lamp which is constituted in such a manner that a starter which is in parallel connected to a luminous tube is accommodated in a light transmissible vacuum outer bulb thereof, said metal vapor discharge lamp being characterized in that: said starter is constituted by in series connecting a coiled nonfusible metal wire which is wound to or laid along the outer wall of said luminous tube in a contact manner, a nonlinear capacitor and a semiconductor switch.

6. A metal vapor discharge lamp according to claim 5, wherein said semiconductor switch forming said starter has a resistor which is in parallel connected thereto.

7. A metal vapor discharge lamp according to claim 5, wherein a resistor which is in parallel connected to said starter is accommodated in said outer bulb.

8. A metal vapor discharge lamp according to claim 6, wherein a resistor which is in parallel connected to said starter is accommodated in said outer bulb.

9. A metal vapor discharge lamp according to claim 5, wherein thermal response switches which are turned on at the time of non-heating are connected to two ends of said nonfusible metal wire which forms said starter.

10. A metal vapor discharge lamp according to claim 6, wherein thermal response switches which are turned on at the time of non-heating are connected to two ends of said nonfusible metal wire which forms said starter.

11. A metal vapor discharge lamp according to claim 7, wherein thermal response switches which are turned on at the time of non-heating are connected to two ends of said nonfusible metal wire which forms said starter.

12. A metal vapor discharge lamp according to claim 8 wherein thermal response switches which are turned on at the time of non-heating are connected to two ends of said nonfusible metal wire which forms said starter.

13. A metal vapor discharge lamp according to any of claims 1 to 12, wherein said coiled nonfusible metal wire is, in a case of small capacity lamp less than 150 W, constituted in such a manner that a single wire of diameter of 0.04 to 0.1 mm is formed to a single coil with the inner diameter of 0. 1 to 0.6 mm.

14. A metal vapor discharge lamp according to any of claims 1 to 12, wherein said coiled nonfusible metal wire is, in a case of a lamp exceeding 180 W, constituted in such a manner that a single wire with the diameter of 0.03 to 0.1 mm is formed to a double coil constituted by a primary coil with the inner diameter of 0.06 to 0.2 mm and a second coil with the inner diameter of 0.15 to 0.5 mm.

* * * * *